US009108115B1

(12) United States Patent
Fung

(10) Patent No.: US 9,108,115 B1
(45) Date of Patent: Aug. 18, 2015

(54) TOY RESPONSIVE TO BLOWING OR SOUND

(71) Applicant: SILVERLIT LIMITED, Causeway Bay (HK)

(72) Inventor: Choi Kei Fung, Causeway Bay (HK)

(73) Assignee: Silverlit Limited, Hong Kong (HK)

( * ) Notice: Subject to any disclaimer, the term of this patent is extended or adjusted under 35 U.S.C. 154(b) by 0 days.

(21) Appl. No.: 14/467,886

(22) Filed: Aug. 25, 2014

(51) Int. Cl.
*A63H 3/28* (2006.01)
*A63H 5/00* (2006.01)
*A63H 13/00* (2006.01)

(52) U.S. Cl.
CPC .. *A63H 3/28* (2013.01); *A63H 5/00* (2013.01); *A63H 13/005* (2013.01)

(58) Field of Classification Search
CPC ..... G08B 21/12
USPC ..... 446/175
See application file for complete search history.

(56) References Cited

U.S. PATENT DOCUMENTS

| | | | | |
|---|---|---|---|---|
| 5,316,516 | A * | 5/1994 | Saitoh | 446/175 |
| 5,446,236 | A * | 8/1995 | Nakada et al. | 84/102 |
| 5,587,545 | A * | 12/1996 | Nakada et al. | 84/600 |
| 5,890,947 | A * | 4/1999 | Tanaka et al. | 446/298 |
| 6,149,490 | A * | 11/2000 | Hampton et al. | 446/353 |
| 6,514,117 | B1 | 2/2003 | Hampton et al. | |
| 6,544,098 | B1 * | 4/2003 | Hampton et al. | 446/301 |
| 7,068,941 | B2 | 6/2006 | Fong et al. | |
| 7,568,963 | B1 * | 8/2009 | Atsmon et al. | 446/175 |
| 8,371,897 | B1 | 2/2013 | Wong | |
| 8,444,452 | B2 * | 5/2013 | Dang et al. | 446/397 |
| 8,764,510 | B1 | 7/2014 | Wong | |
| 2004/0180603 | A1 * | 9/2004 | Barri et al. | 446/175 |
| 2008/0166945 | A1 | 7/2008 | Cheng et al. | |
| 2009/0280717 | A1 * | 11/2009 | Chan | 446/175 |
| 2011/0014848 | A1 * | 1/2011 | Law | 446/330 |
| 2011/0018198 | A1 * | 1/2011 | Prasanna | 273/237 |
| 2011/0066239 | A1 * | 3/2011 | Smoot et al. | 623/6.64 |
| 2011/0081820 | A1 * | 4/2011 | Faecher | 446/15 |
| 2011/0097964 | A1 * | 4/2011 | Law | 446/72 |
| 2012/0083182 | A1 | 4/2012 | Heatherly et al. | |

(Continued)

FOREIGN PATENT DOCUMENTS

| | | | |
|---|---|---|---|
| CN | 2117189 | U | 9/1992 |
| EP | 1832324 | A1 | 9/2007 |

(Continued)

OTHER PUBLICATIONS

Tomy Micropets Commercial; www.ElectronicPetShop.com, uploaded May 8, 2009; https://www.youtube.com/watch?v=17cd56pTo44.

(Continued)

*Primary Examiner* — Pierre Eddy Elisca
*Assistant Examiner* — Alex F. R. P. Rada, II
(74) *Attorney, Agent, or Firm* — Greenberg Traurig, LLP

(57) ABSTRACT

An interactive toy has an outer shell, with a non-reactive portion and a first reactive portion. There is a blow sensor for sensing blowing on the shell by a user or from sound from the user or another toy. A microprocessor processes the blowing or sound and generates instructions to cause operation of the reactive portion of the body. Several toys can be responsive to at least one of the toys or sounds, the responsiveness being generated from the user or from other of the several toys to obtain a multiple reaction of multiple toys as a started from an initial blowing or sound by a user or by a sound generation by of the multiple toys.

14 Claims, 11 Drawing Sheets

(56) References Cited

U.S. PATENT DOCUMENTS

| | | | | |
|---|---|---|---|---|
| 2013/0000164 | A1* | 1/2013 | Shah et al. | 40/124.02 |
| 2013/0072080 | A1* | 3/2013 | Garbos et al. | 446/26 |
| 2013/0283650 | A1* | 10/2013 | Wilson et al. | 40/124.02 |

FOREIGN PATENT DOCUMENTS

| | | | |
|---|---|---|---|
| JP | H11179061 | A | 7/1999 |
| WO | 2004024276 | A1 | 3/2004 |

OTHER PUBLICATIONS

Tomy Takara Micro Pets-I Demonstration, www.ElectronicPetShop.com, uploaded Feb. 24, 2010, https://www.youtube.com/watch?v=88wBk3WHU2k.

Silverlit © 2014 Silverlit Toys Manufactory Limited, DigiBirds™ http://www.digibirds.com/en, http://www.youtube.com/watch?v=SkWEoeFFv4l.

European Search Report for Application No. EP14186481.

* cited by examiner

FIG. 8 Block diagram of Digibirds

TOY RESPONSIVE TO BLOWING OR SOUND

FIELD OF THE DISCLOSURE

The disclosure relates to a toy that can interact with a user of the toy.

The present disclosure is concerned with the technology for toys to be reactive blowing by a user or sound and to be interactive or independent in their reaction.

SUMMARY

The disclosure is an interactive toy and method for operating a toy where the toy comprises a body having an outer shell, the shell having a non-reactive portion and a first reactive portion. There can be a blow sensor with the body for sensing a pressure caused by blowing on the shell by a human user in the vicinity of the body. There is a microprocessor for processing the blowing pressure and generating instructions in response to the blowing pressure. The instructions cause operation of the reactive portion of the body.

The interactive toy can include a speaker in the body of the toy, and the microprocessor can include a routine for analyzing sound in the vicinity of the body, and cause the sound to develop a reaction by the toy, the reaction being the emission of a sound from the speaker.

There is also second toy bird including a body having an outer shell, the shell having a non-reactive portion and a first reactive portion; a blow sensor with the body for sensing a pressure caused by blowing on the shell by a human user in the vicinity of the body. A microprocessor processes the blowing pressure and generates instructions in response to the blowing pressure, the instructions cause operation of the reactive portion of the body. A speaker emits sound as part of the operation. A reaction by the first toy causing a responsive reaction by the second toy.

In yet a further form there is an interactive toy comprising a first toy bird including a body having an outer shell, the shell having a non-reactive portion and a first reactive portion. A sensor with the body senses a sound caused by a human user in the vicinity of the body. A microprocessor processes the sound and generates instructions in response to, the instructions causing operation of the reactive portion of the body. A speaker emits sound as part of the operation.

There is also a second toy bird including a body having an outer shell, the shell having a non-reactive portion and a first reactive portion. A sensor with the body for sensing a sound caused by a human user in the vicinity of the body. A microprocessor processes the sound and generates instructions in response to, the instructions causing operation of the reactive portion of the body. A speaker emits sound as part of the operation. A reaction by the first toy causes a responsive reaction by the second toy.

The sound can be provided by a user or one of the toys or of multiple toys. Many toys can be interactive to develop a mass reaction of toys to the blowing and/or sound.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which.

DETAILED DESCRIPTION

Figure 1:
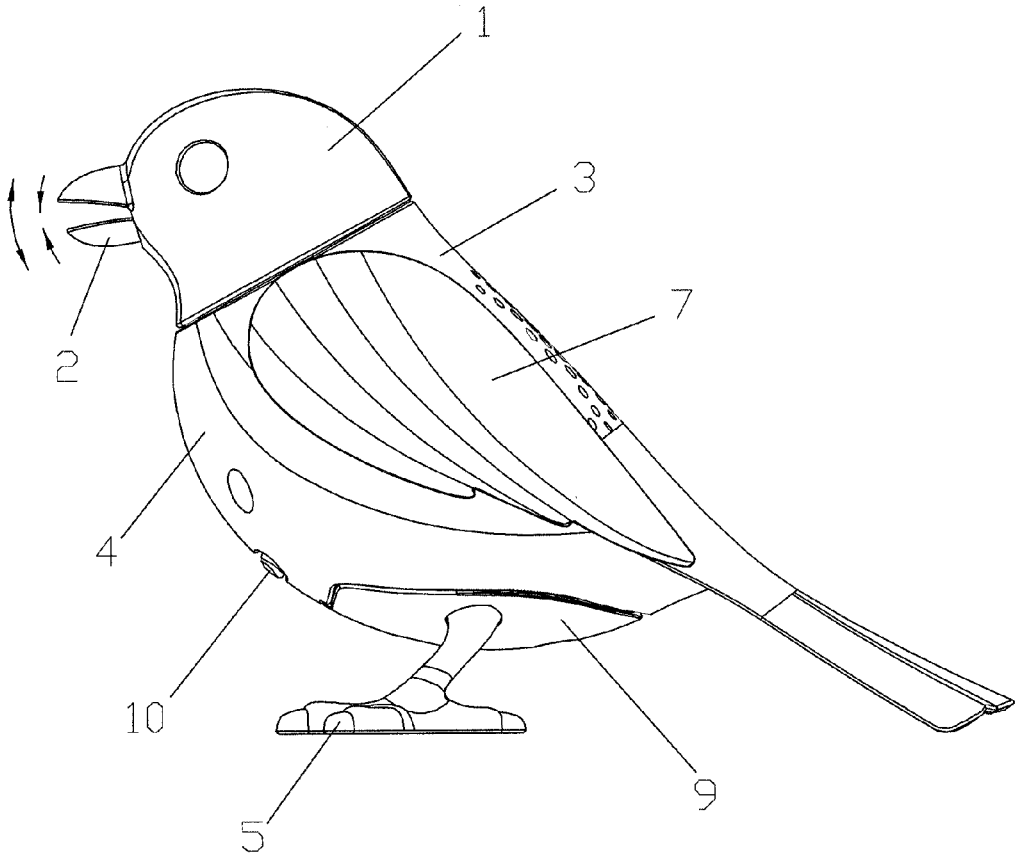
FIG. 1 illustrates a side view of a toy bird in accordance with the disclosure with arrows that show that the beak of the mouth, being two members, can open and close relative to each other. This is affected by one member of the beak moving relative to the other member of the beak.
Figure 2:
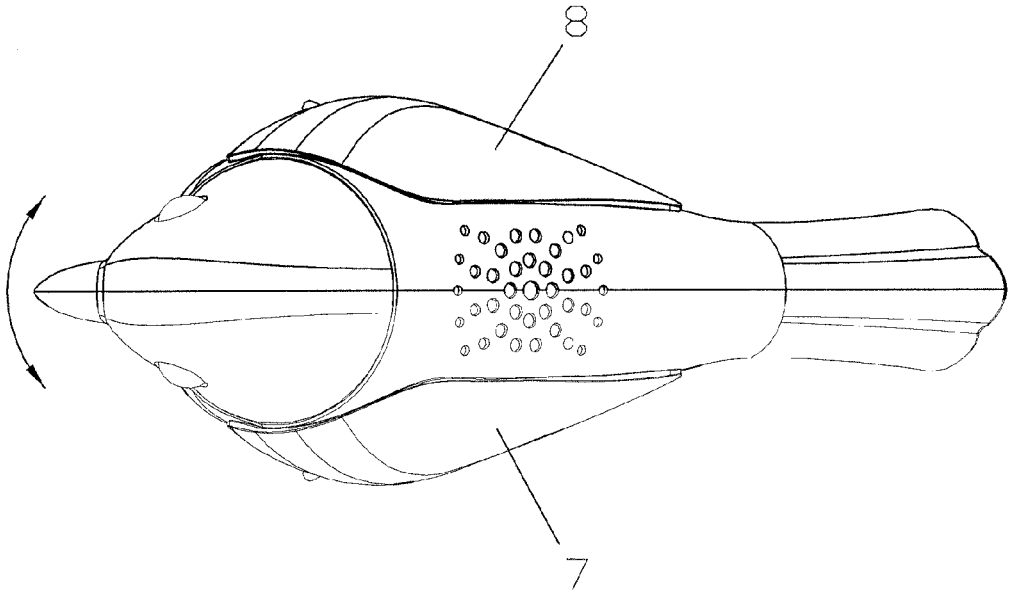
FIG. 2 illustrates a top view of a toy bird in accordance with the disclosure with arrows that show that the head of the bird can turn left or right relative to the upper portion of the body.
Figure 3:
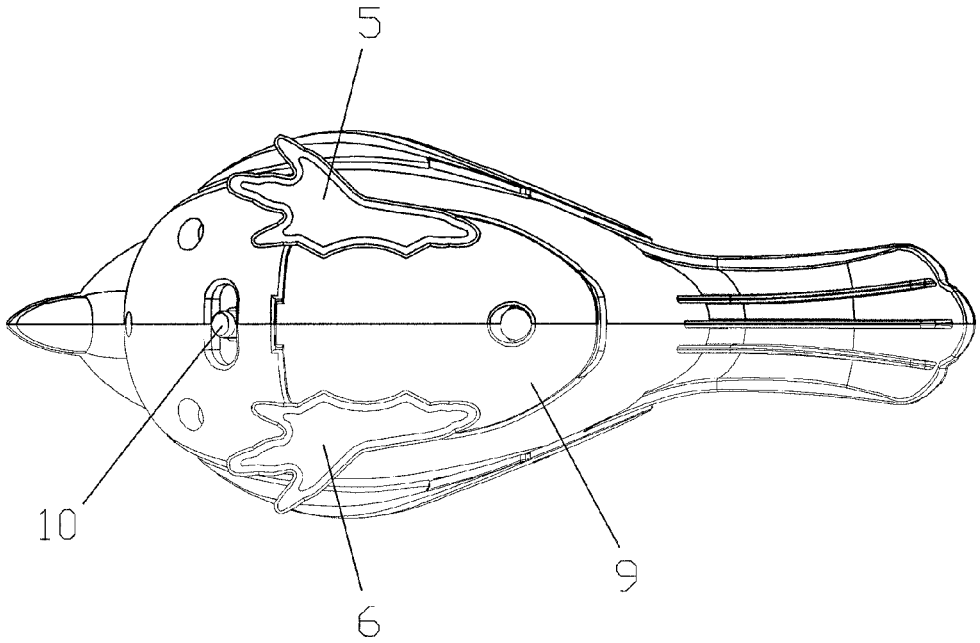
FIG. 3 illustrates a under view of a toy bird in accordance with the disclosure.
Figure 4:
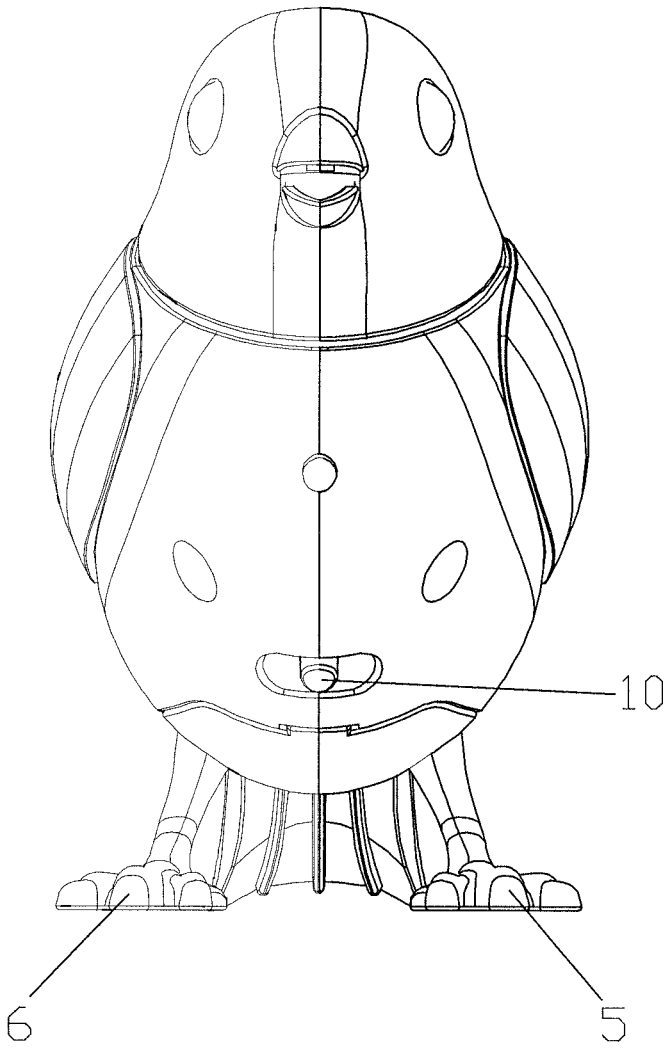
FIG. 4 illustrates a front view of a toy bird in accordance with the disclosure.
Figure 5:
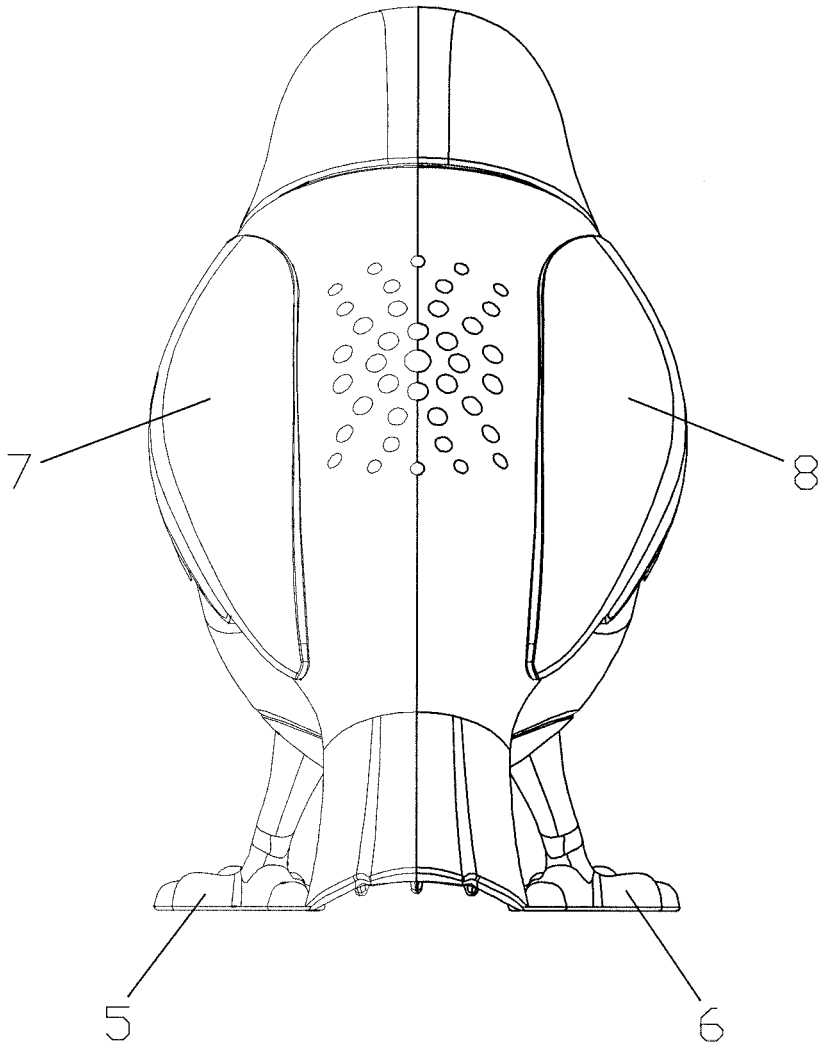
FIG. 5 illustrates a rear view of a toy bird in accordance with the disclosure.
Figure 6:
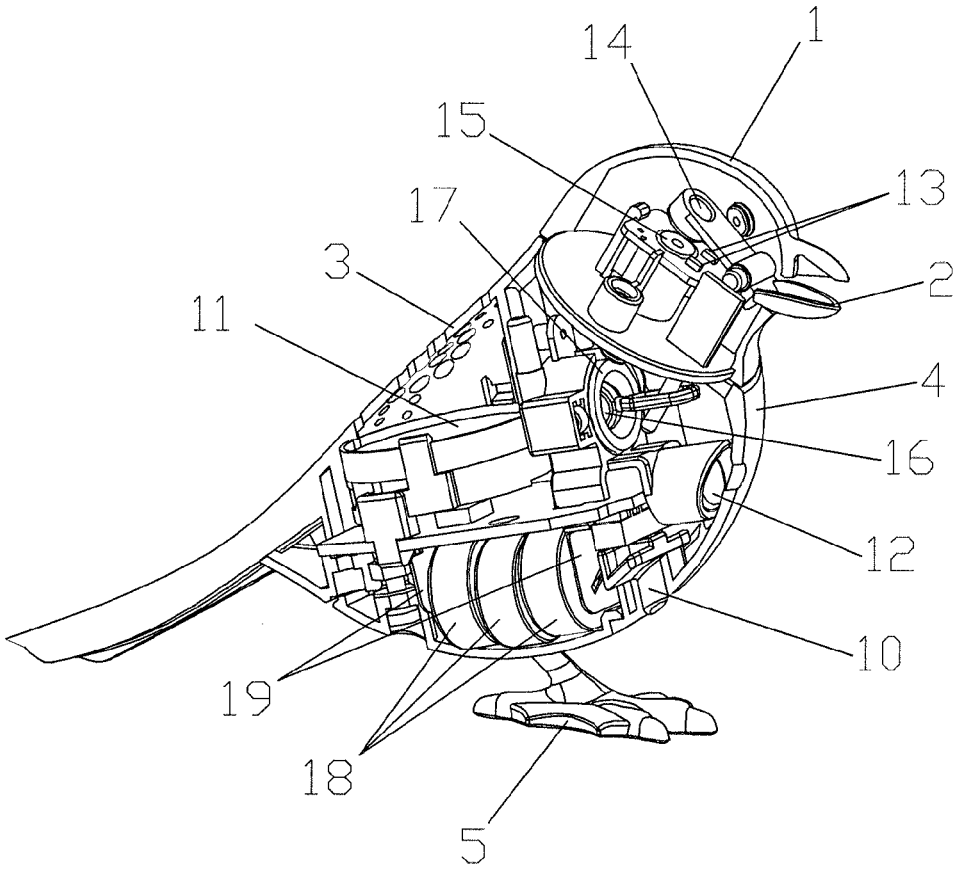
FIG. 6 illustrates an opened side view of a toy bird in accordance with the disclosure.
Figure 7:
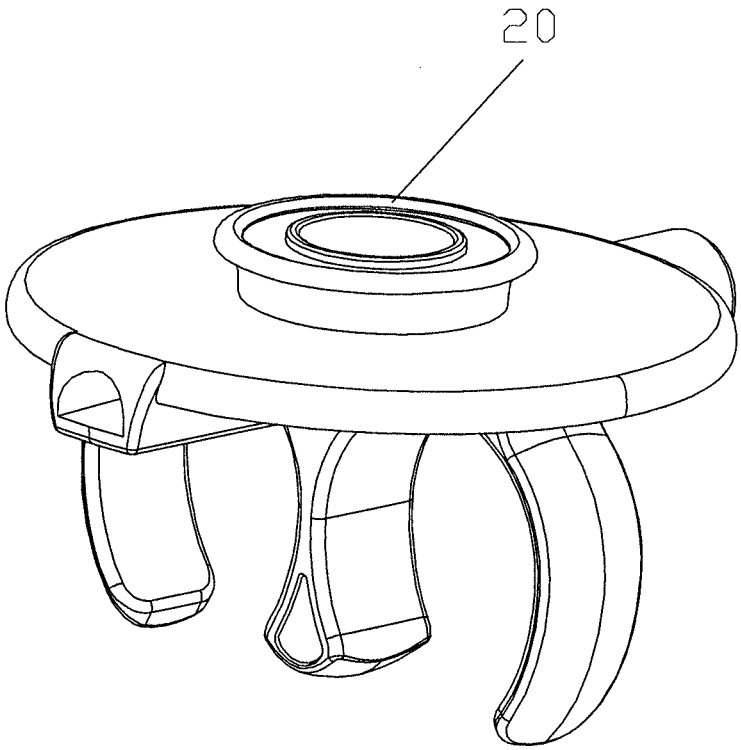
FIG. 7 illustrates a perspective view of a whistle for creating a sound by the user for toy bird in accordance with the disclosure.
Figure 8:
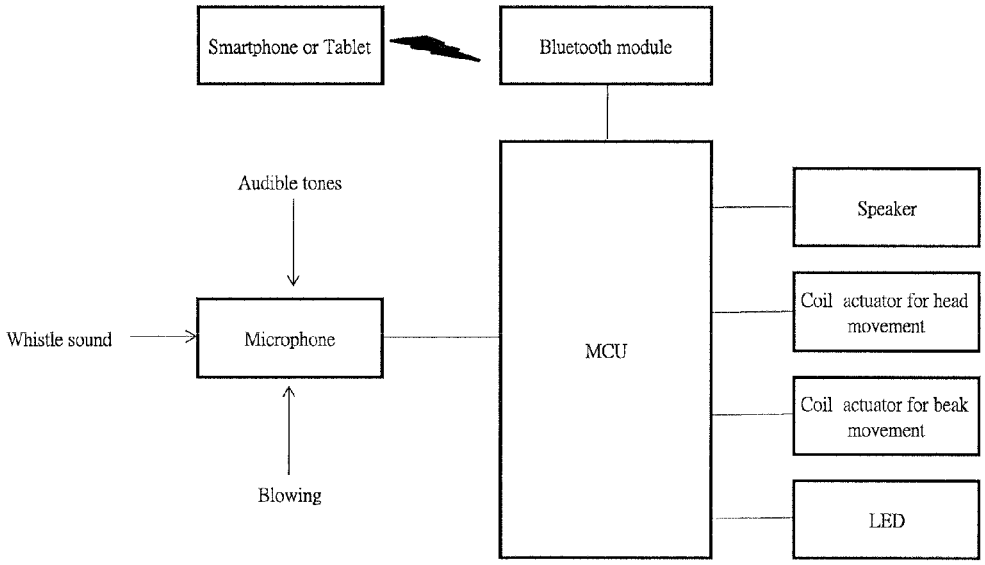
FIG. 8 illustrates a block diagram of components of the toy showing a Bluetooth connection to a Smartphone.
Figure 9:
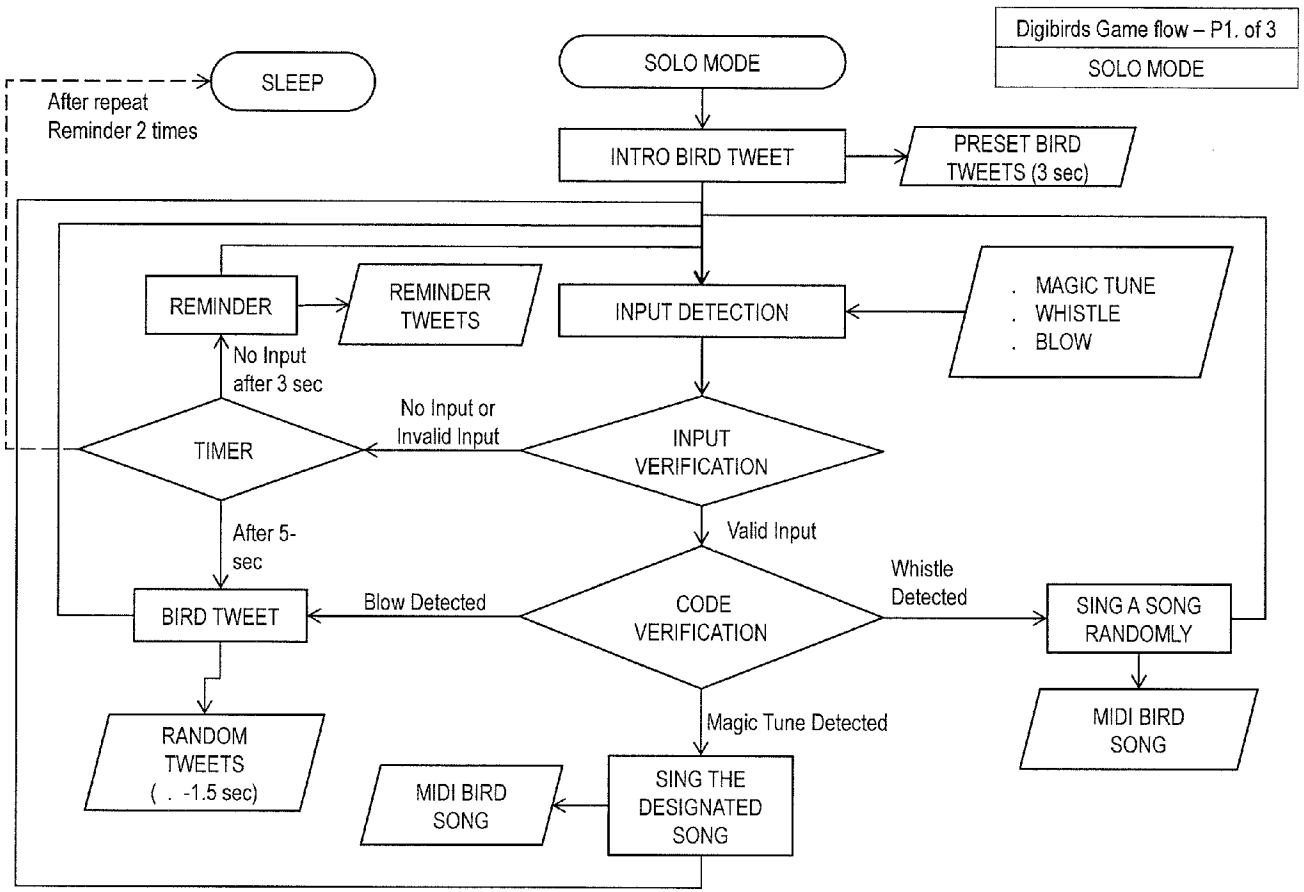
FIG. 9 illustrates a flow diagram of the solo mode of the operation of the toy.
Figure 10:
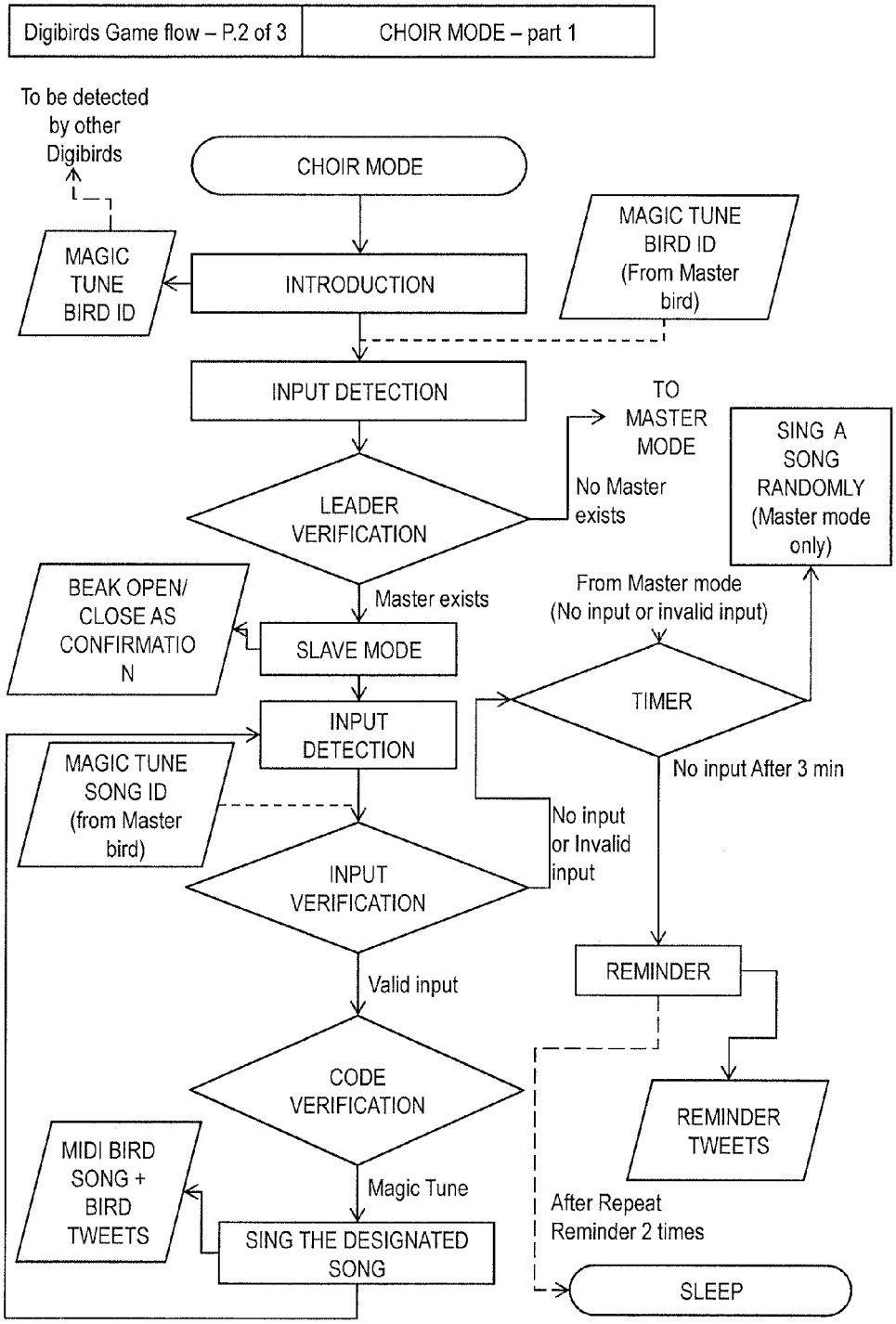
FIG. 10 illustrates one flow diagram of the choir mode of the operation of the toy.
Figure 11:
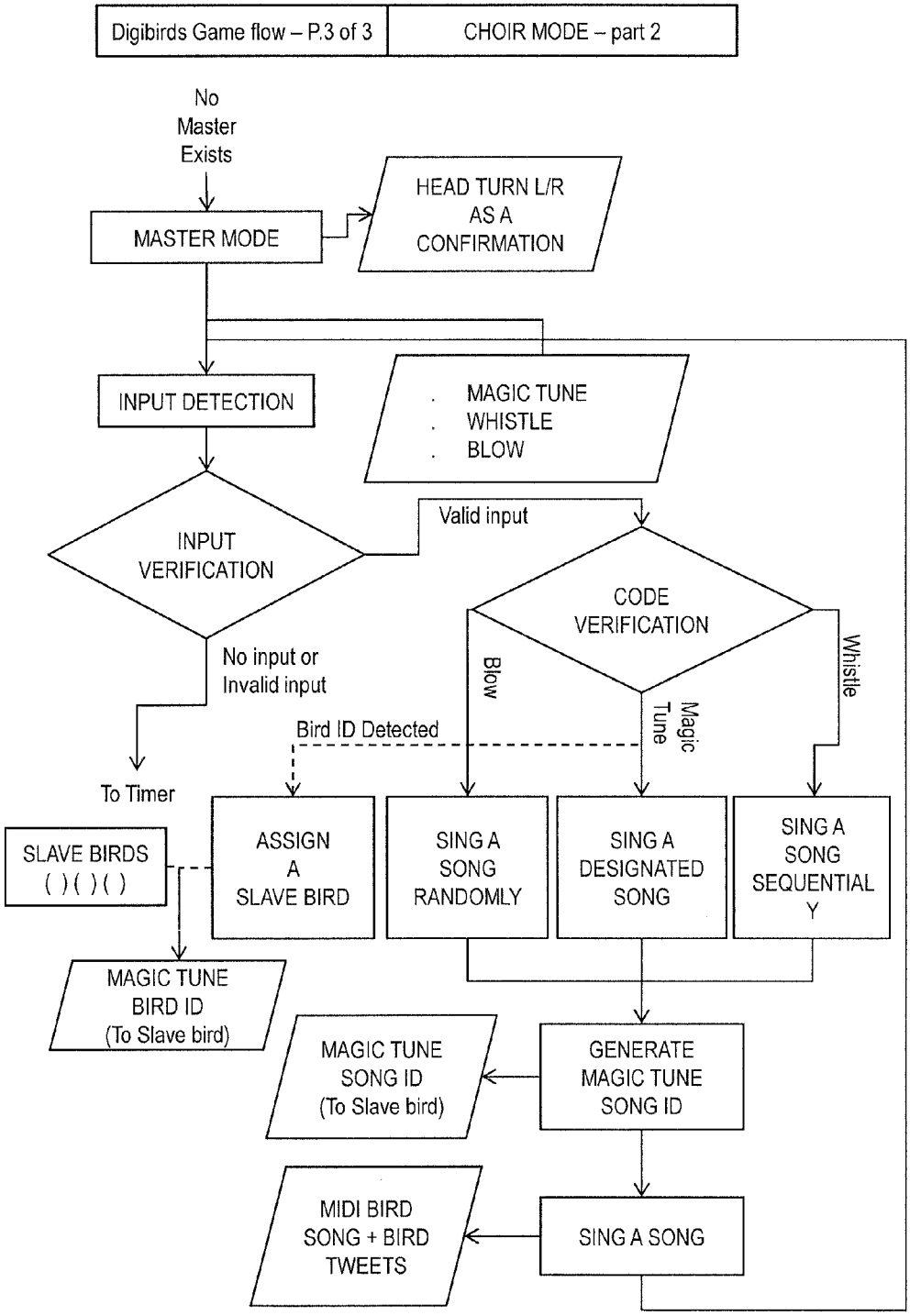
FIG. 11 illustrates a second flow diagram of the choir mode of the operation of the toy.

The disclosure is an interactive toy comprising a body having an outer shell, the shell having a non-reactive portion and a first reactive portion. There is a blow sensor with the body for sensing a pressure caused by blowing on the shell by a human user in the vicinity of the body. There is a microprocessor for processing the blowing pressure and generating instructions in response to the blowing pressure. The instructions cause operation of the reactive portion of the body.

The microprocessor generates signals to sequentially activate and deactivate a first electrical coil thereby to sequentially attract and release a first magnet thereby to cause movement of the interactive toy. The movement causes relative changes in position between non-reactive portion and the first reactive portion.

The interactive toy can include a second reactive portion of the shell, and a second coil. Generating the signals sequentially activates and deactivates the second electrical coil thereby sequentially attracting and releasing a second magnet thereby to cause second movement of the interactive toy. The movement causes relative changes in position between a non-reactive portion and a second reactive portion The interactive toy is a bird, and the bird has a head, a mouth, and a body. The changes in position of the first reactive portion are exhibited as the sequentially opening and closing of the mouth of the bird. A change in position of the second reactive portion is exhibited as the turning of the head of the bird relative to the body of the bird. There can be different combinations of mouth movement and head movement and body movement.

The interactive toy can include a speaker in the body of the toy, and the microprocessor can include a routine for analyzing sound in the vicinity of the body, and cause the sound to develop a reaction by the toy, the reaction being the emission of a sound from the speaker.

The microprocessor includes a routine for analyzing different sounds in the vicinity of the body, and classifying the sounds to develop different reactions by the toy, the reactions being selected as being at least one of from the group of movement of a reactive portion of the toy or the emission of sound from the speaker.

The interactive toy can include an aperture in the shell for receiving the blowing pressure to thereby activate the microprocessor.

In another form the interactive toy comprises a first toy bird including a body having an outer shell, the shell having a non-reactive portion and a first reactive portion. There is a blow sensor with the body for sensing a pressure caused by blowing on the shell by a human user in the vicinity of the body. A microprocessor processes the blowing pressure and generates instructions in response to the blowing pressure, the instructions cause operation of the reactive portion of the body. A speaker is provided for emitting sound as part of the operation.

There is also a second toy bird including a body having an outer shell, the shell having a non-reactive portion and a first reactive portion; a blow sensor with the body for sensing a pressure caused by blowing on the shell by a human user in the vicinity of the body. A microprocessor processes the blowing pressure and generates instructions in response to the blowing pressure, the instructions cause operation of the reactive portion of the body. A speaker emits sound as part of the operation. A reaction by the first toy causing a responsive reaction by the second toy.

In yet a further form there is an interactive toy comprising a first toy bird including a body having an outer shell, the shell having a non-reactive portion and a first reactive portion. A sensor with the body senses a sound caused by a human user in the vicinity of the body. A microprocessor processes the sound and generates instructions in response to, the instructions causing operation of the reactive portion of the body. A speaker emits sound as part of the operation.

There is also a second toy bird including a body having an outer shell, the shell having a non-reactive portion and a first reactive portion. A sensor with the body for sensing a sound caused by a human user in the vicinity of the body. A microprocessor processes the sound and generates instructions in response to, the instructions causing operation of the reactive portion of the body. A speaker emits sound as part of the operation. A reaction by the first toy causes a responsive reaction by the second toy.

The toy can include a communication module wherein the toy is connectable with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device.

The invention also includes a method of operating an interactive toy comprising including an interactive toy. There is a first toy comprising a body having an outer shell, the shell having a non-reactive portion and a first reactive portion and an aperture in the shell; a blow sensor with the body for sensing a pressure caused by blowing on the shell by an human user in the vicinity of the body; or a sensor for sound in the vicinity of the toy; and a microprocessor for processing the blowing pressure, The steps include at least one of:

1. blowing at the aperture in the shell;
2. sensing a pressure caused by blowing on the shell by an human user in the vicinity of the body;
3. activating a microprocessor in response to the blowing pressure
4. generating instructions in response to the blowing pressure, and
5. causing operation of the reactive portion of the body; or
6. generating a sound towards the shell;
7. sensing the sound generated by an human user in the vicinity of the body;
8. activating a microprocessor in response to the sound;
9. generating instructions in response to the sound; and
10. causing operation of the reactive portion of the body.

The steps of blowing at the aperture in the shell; sensing a pressure caused by blowing on the shell by an human user in the vicinity of the body; activating a microprocessor in response to the blowing pressure generating instructions in response to the blowing pressure, and causing operation of the reactive portion of the body.

The signals are generated to sequentially activate and deactivate a first electrical coil; sequentially attracting or releasing a first magnet thereby to cause movement of the interactive toy. The movement is being by causing relative changes in position between non-reactive portion and the first reactive portion. Also there is the changing the position of the first reactive portion exhibits as the turning of the head of the bird relative to the body of the bird.

Further there is the analyzing of sound in the vicinity of the body, and causing the sound to develop a reaction by the toy, the reaction being the emission of a sound from the speaker. There can be the classifying of the sounds to develop different reactions by the toy. The reactions can be selected as being at least one of from the group of movement of a reactive portion of the toy or the emission of sound from the speaker.

The method also includes providing a second toy including the steps of blowing at the aperture in the shell of the first or second toy; sensing a pressure caused by blowing on the shell by a human user in the vicinity of the body of the toy into which there has been a blowing pressure. This activates in the toy into which there has been a blowing pressure; a microprocessor in response to the blowing pressure; and generating in the toy into which there has been a blowing pressure instructions in response to the blowing pressure. This causes in the toy into which there has been a blowing pressure an operation of the reactive portion of the body. A sound in the toy into which there has been a blowing pressure is emitted. A responsive reaction from the toy into which there has been a blowing pressure is caused in and to the other toy.

In an alternative method format there is provided in the first toy a speaker for emitting sound as part of the operation. A second toy includes a speaker for emitting sound as part of the operation; a sound sensor with the body. A microprocessor processes the blowing pressure.

The operation including the steps of blowing at the aperture in the shell of the first toy; sensing a pressure caused by blowing on the shell by a human user in the vicinity of the body of the first toy. There is then the activating of a microprocessor in response to the blowing pressure. This generates instructions in response to the blowing pressure, and causes an operation of the reactive portion of the body. This can be emitting a sound in the toy into which there has been a blowing pressure; and causing a responsive reaction in the second toy.

As a toy bird, there is the sequential opening and closing of the mouth of the bird and/or the changing the position of the first reactive portion exhibits as the turning of the head of the bird relative to the body of the bird.

The method includes analyzing different sounds in the vicinity of the body, classifying the sounds to develop different reactions by the toy. The reactions are selected as being at least one of from the group of movement of a reactive portion of the toy or the emission of sound from the speaker. Also there is classifying the sounds to develop different reactions by the toy.

The method also includes connecting the toy with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device.

The can be several toys to be responsive to at least one of the toys or sounds, the responsiveness being generated from the user or from other of the several toys. Thereby there is obtained a multiple reaction of multiple toys as a started from an initial blowing or sound by a user or by a sound generation by of the multiple toys.

The various parts of the drawings are set out as follows:

| PART NO. AND NAME | |
|---|---|
| No. | Parts Name |
| 1 | Head |
| 2 | Beak |
| 3 | Upper body |
| 4 | Lower body |
| 5 | Left foot |
| 6 | Right foot |
| 7 | Left wing |
| 8 | Right wing |
| 9 | Battery door |
| 10 | Main switch |
| 11 | Speaker |
| 12 | Mic |
| 13 | LEDs |
| 14 | Magnet |
| 15 | Coil |
| 16 | Magnet |
| 17 | Coil |
| 18 | Batteries |
| 19 | battery contacts |
| 20 | Whistle |

There can be a different number of coils driven by different magnets or magnetic systems.

In one form of operation, there are two control methods to drive the coils 15 and 17:

a. Activate and deactivate a coil to attract and release the magnet. This method is applied in a first coil 15 and magnet 14 and operates the one or both elements of the beak 2 of the bird. In the form shown the movable part of the beak 2 is the lower part of the pair which is part of the mouth, relative to top beak part of the mouth which is integrated and molded as a part of the head 1.

b. Current flow through a coil in one direction or current flow in opposite direction to activate the coil or no current to deactivate the coil so that the magnet can be attracted to one end, or repelled to other end or in neutral position respectively. This control method is applied in a second coil 17 and magnet pair 16, and is used to operate the head 1 for turning left, right and returning to the neutral position.

The effect of the moving the mouth of the bird concurrently with sound emanating from the bird provides a more realistic experience for the user of the toy.

Product Features and Flow

The bird toy has built in 34 songs—20 songs can be triggered by normal play via commands such as BLOW, WHISTLE or MAGIC TUNE, plus 14 hidden songs to be unlocked after download the bird toy Smartphone app.

Each bird toy comes with a default tweet (bird voice); the user will hear 2nd & 3rd bird tweets respectively after the bird toy has sung certain songs. The unlocked bird tweets will be reset once the bird toy is switched off.

The bird toy reacts to 3 kinds of commands:

BLOW—blow to the bird toy chest for approx. 3 secs.

WHISTLE—use the supplied Whistle ring to whistle; or human whistle that in same frequency as the Whistle ring.

MAGIC TUNE—Magic Tune is use for the bird toy to communicate to each other and as a Song code in Choir mode, each built in song has a specific MAGIC TUNE assigned, the bird toy will sing the designated song when the MAGIC TUNE is received.

When the bird toy is tweet or sing, its head turns and the beak moves according to the tune.

The bird toy has two game modes, Solo mode and Choir mode.

SOLO mode—The bird toy will randomly chirping, player can activate the bird toy to tweet by blow to it chest, or whistling to activate the bird toy to sing a song sequentially from its built in 20 song library. The bird toy can also be activated a designated song by the Magic Tune generated by Smartphone app.

CHOIR mode—for play with a group of the bird toys, by set up a one of the bird toy as master and it will lead the group of the bird toy to sing. This works the same as the Solo mode: the choir also receives WHISTLE or MAGIC TUNE to sing. If there is no input received, the master the bird toy will lead the choir to sing a song the go to sleep after 3 songs.

Start Up

Start to play by turn on the power switch to SOLO mode & CHOIR mode. The bird toy will generate a slow bird tweet if battery is too low.

The bird toy listens to the commands in indoor environment within 8-10" range, background noise sometimes may affect the accurateness of command recognition.

Solo Mode

After being switched to SOLO mode, the bird toy will generate bird tweet as an introduction, then start to listen to the commands (waiting status).

For every 7-10 sec of waiting, the bird toy will generate bird tweets in random length and in random combination to attract owner's attention.

If an input is received, the bird toy will analysis the type of input with following reactions:

BLOW up to 3 sec approx—response with a random length bird tweet, then go to waiting status again.

WHISTLE (in specific frequency range)—the bird toy will response with singing a song, then go to waiting status again.

MAGIC TUNE—The bird toy will response with singing the designated song according to the MAGIC TUNE, and then go to waiting status again.

Out of above input or no input received—every 7-10 sec, the bird toy will generate bird tweets in random timing, random length and random combination, then generate a tired bird tweet as a reminder after every 2 minute, then go to sleep.

After the bird toy goes to sleep, it can be reactive by switch to power switch to OFF and back to SOLO or CHOIR again.

Choir Mode

To play in CHOIR mode, players has to pair the bird toy and it is limited that only one the bird toy can be paired each time.

After switched to CHOIR mode, the bird toy will generate a MAGIC TUNE as its ID, and then start to search if there is any other the bird toy around. There are 2 scenarios:

If there is no other bird toy MAGIC TUNE ID received, the bird toy will turn its head few times as a sign to confirm itself as a MASTER bird. It then starts searching again.

If there is another bird toy switched on and assigned itself as MASTER bird already, the later switch on the bird toy will receive another MAGIC TUNE ID from the MASTER bird, the later switch on bird toy will be assigned as a FOLLOWER bird and moves its beak few times as a sign of confirmation.

After MASTER bird has assigned FOLLOWER bird/s, it will start searching again and if there is no detection for 15 sec, the MASTER bird will start leading the Choir to sing by sending out a MAGIC TUNE. The choir will sing a song every 30-40 sec for up to 3 songs the go to waiting status again.

Once a bird toy is assigned as a FOLLOWER bird, it will stay silent and wait for command from MASTER bird.

If a MASTER bird has successfully paired with FOLLOWER bird(s), the MASTER BIRD will react to following commands:

BLOW or WHISTLE—generate a song MAGIC TUNE then lead the FOLLOWER birds to sing the song together.

MAGIC TUNE—sing the designated song together with the FOLLOWER birds.

If a MASTER bird has not paired with any FOLLOWER birds, it will sing a song every 30-40 sec for up to 3 songs, and then go to waiting status.

Sleep Mode

In SOLO & CHOIR mode, the bird toy will automatically go to sleep mode if no WHISTLE or MAGIC TUNE commands received for approximately 10 min (time to sleep is various as bird tweet length are not fixed).

Before the bird toy goes sleep, it will generate a tired bird tweet as a reminder and repeat after 2 minutes.

To turn on the bird toy again, slide the switch to OFF and then to SOLO or CHOIR mode.

Bird Tweet & Song Unlock

Each bird toy has 3 built in bird tweet (bird voice) and it comes with a default tweet. After the bird toy has sung 10 & 20 songs, the user will hear 2nd & 3rd bird tweets respectively. The unlocked bird tweets will be reset once the bird toy is switched off.

The bird toy has built in 34 songs—20 songs can be triggered by normal play via commands such as BLOW, WHISTLE or MAGIC TUNE; 14 hidden songs can be triggered by MAGIC TUNE which can be gained by playing the mini games in the Smartphone app.

Low Battery Detection

When the battery power is low during the play or while the user turns on the bird, the bird toy will generate an alert—a tired bird tweet or vibrate its beak as a reminder that battery replacement is required.

Interaction with Smartphone App

By using the Smartphone App, the user can send MAGIC TUNE to the bird toy for play the song the user wants.

The Smartphone contains MAGIC TUNE of 20 default songs, the user can gain the MAGIC TUNE of 14 hidden songs by playing the built in mini games.

Once the MAGIC TUNE of new song is gained, it will be available in the song list for play anytime.

The method in which mobile devices such as Smartphone, tablet or the toy bird generates a series of dedicated audible tone to establish the pairing between the bird toys or to activate an event.

A method in which an event is activated by whistle sound.

A method in which an event is activated by blowing An event includes a) Perform group or solo singing, or b) Perform tweeting, or c) Perform beak, head, body, legs or wings movement The bird toy are interactive toy birds that can chirp, tweet, sing and move, they responding to players' commands in whistles, blow or Magic tunes from the Smartphone app. They can be played individually as a solo or play in a group as a choir.

In solo play, the bird toy will generate chirping sound randomly and the user can blow or whistle to make the bird toy tweet or sing. In Choir play, the user can get two or more of the bird toy pair together, and then they will form a 'choir' to sing synchronously.

The bird toy has built in more than 30 songs and different bird tweets. With more play, the user can discover more bird tweet or songs. For example, more bird tweets will be unlocked after certain play or the user can download the bird toy Smartphone app to generate Magic Tunes to make the bird toy sing more songs.

The interactive toy can include the microprocessor or a second microprocessor, the second microprocessor being selected to operate features selected from the group consisting of handling power management of the toy, controlling at least one or more motors of the toy, driving an LED and playing sound effect, melody, song and message associated with the toy.

There can be an external memory for data and program storage, and for interacting with the microprocessor.

The interactive toy can include multiple motors and multiple gear boxes respectively, each motor and gearbox being for effecting movement of an element of the reactive portion, the element being at least one of ears, eyes, head, hands, legs or other body component.

The interactive toy can include at least one of a microphone sensor for speech recognition input, capacitive sensor for reaction to a touching input, or a proximity sensor for detecting when a user is located at a predetermined distance from the toy.

The microprocessor can include a routine for interactive game play, the routine causing the toy to relate to a user the need to perform one action, and then checking whether the action has been correctly performed. The toy includes a routine for determining the right action relative to a preprogrammed pattern, and providing feedback to a user by causing the toy to react with different selected movements, the movement including selectively at least one of shaking or nodding of a reactive portion or an emission of a sound output.

In one embodiment a toy can be a doll comprising a plush, soft or hard plastic head and body. One or more subsidiary MCUs can be provided for handling power management provided through a battery, controlling coils, motors and gear boxes through motor drivers, driving LEDs and playing sound effect, melody, song and messages through an audio output.

There are external SDRAM and Flash memory devices and respectively for data and program storage.

In other forms of the disclosure, recognition of blowing or sound is used as in different applications recently such as Xbox Kinect, Nintendo Wii remote controller and iPhone, or smart phones. Although the disclosure is described of a toy bird, it is possible to apply the disclosure to other toy embodiments.

The present disclosure may be embodied in specific forms without departing from the essential spirit or attributes thereof. In particular, although the disclosure is illustrated using a particular format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

It will be understood that the toy can be formed of a variety materials and may be modified to include additional routines, processes, switches and/or buttons. It will be further understood that a variety of other types of toys and digital inputs may be used to control the operation of the toy of the present disclosure.

One of ordinary skill will appreciate that although the embodiments discussed above refer to one form of image sensor. There can be other forms of sensors and there could be more than one sensor with the toy and other modes of operation could be used.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the micro processors or controllers with the toy and multiple software routines.

The invention claimed is:

1. An interactive toy comprising:

a body having an outer shell, the shell having a non-reactive portion and a first reactive portion;

a blow sensor with the body for sensing a pressure caused by blowing on the shell by an human user in the vicinity of the body;

a microprocessor for processing the blowing pressure and generating instructions in response to the blowing pressure, the instructions being for causing operation of the reactive portion of the body;

wherein the microprocessor includes generating signals to sequentially activate and deactivate a first electrical coil thereby to sequentially attract and release a first magnet thereby to cause movement of the interactive toy, the movement being by causing relative changes in position between non-reactive portion and the first reactive portion;

a second reactive portion of the shell, and a second coil, and wherein generating the signals to sequentially activate and deactivate the second electrical coil thereby sequentially attracts and releases a second magnet thereby to cause second movement of the interactive toy, the movement being by causing relative changes in position between a non-reactive portion and a second reactive portion;

wherein the toy is a bird, the bird having a head, a mouth having a beak with two elements, and a body, and a change in position of the first reactive portion is exhibited as the sequentially opening and closing of the mouth of the bird;

wherein the change in position of the second reactive portion is exhibited as the turning of the head of the bird relative to the body of the bird, and including two coils, and two controls to drive the respective coils independently including:

activating and deactivating a first coil to attract and release a first magnet, and thereby operate the mouth by relative first movement up or down of one or both elements of the beak of the bird and thereby open and close the mouth; and activating and deactivating a second coil to activate the second coil in one direction or in an opposite direction or to be deactivated whereby the second coil acts on a second magnet to be attracted to one end or repelled to other end or in neutral position respectively and thereby to operate the head for turning left, right and returning to a neutral position, which turning action is a movement sense which is not up and down and is different to the first movement.

2. The interactive toy as claimed in claim 1 including a speaker in the body of the toy, and wherein the microprocessor includes a routine for analyzing sound in the vicinity of the body, and causing the sound to develop a reaction by the toy, the reaction being the emission of a sound from the speaker.

3. The interactive toy as claimed in claim 1 including a speaker in the body of the toy, and wherein the microprocessor includes a routine for analyzing different sounds in the vicinity of the body, and classifying the sounds to develop different reactions by the toy, the reactions being selected as being at least one of from the group of movement of a reactive portion of the toy or the emission of sound from the speaker.

4. The interactive toy as claimed in claim 1 including an aperture in the shell for receiving the blowing pressure to thereby activate the microprocessor.

5. The toy as claimed in claim 1 including a communication module wherein the toy is connectable with a digital input device thereby to link the toy with digital input device through at least one of a USB, Bluetooth™, Zigbee™, or WiFi communication protocol whereby the toy is configured to receive at least one of a predefined object set, voice, melody, song or sound effect from the digital input device.

6. The toy as claimed in claim 1 including providing several toys to be responsive to at least one of the toys or sounds, the responsiveness being generated from the user or from other of the several toys thereby to obtain a multiple reaction of multiple toys as a started from an initial blowing or sound by a user or by a sound generation by of the multiple toys.

7. A method of operating an interactive toy comprising:

the toy being a first toy comprising a body having an outer shell, the shell having a non-reactive portion and a first reactive portion and an aperture in the shell;

a blow sensor with the body for sensing a pressure caused by blowing on the shell by an human user in the vicinity of the body; or a sensor for sound in the vicinity of the toy; and a microprocessor for processing the blowing pressure, including the steps of at least one of:

(a) blowing at the aperture in the shell;

sensing a pressure caused by blowing on the shell by an human user in the vicinity of the body;

activating a microprocessor in response to the blowing pressure generating instructions in response to the blowing pressure, and causing operation of the reactive portion of the body; or (b) generating a sound towards the shell;

sensing the sound generated by an human user in the vicinity of the body;

activating a microprocessor in response to the sound;

generating instructions in response to the sound; and causing operation of the reactive portion of the body (c) generating signals to independently sequentially activate and deactivate a first electrical coil; sequentially attracting or releasing a first magnet thereby to cause movement of the interactive toy, and the movement being by causing relative changes in position between non-reactive portion and the first reactive portion;

(d) including a second reactive portion of the shell, and a second coil, and generating the signals to sequentially activate and deactivate the second electrical coil thereby sequentially attracts and releases a second magnet thereby to cause second movement of the interactive toy, and the movement being caused by relative changes in position between a non-reactive portion and a second reactive portion;

(e) wherein the toy is a bird, the bird having a head, a mouth, and a body, and a first changing the position of the first reactive portion exhibits as the sequentially opening and closing of the mouth of the bird; and a second changing the position of the first reactive portion exhibits as the turning of the head of the bird relative to the body of the bird; and (f) including a speaker in the body of the toy, analyzing sound in the vicinity of the body, and causing the sound to develop a reaction by the toy, the reaction being the emission of a sound from the speaker, and classifying the sounds to develop different reactions by the toy, the reactions being selected as being at least one of from the group of movement of a reactive portion of the toy or the emission of sound from the speaker.

8. The method as claimed in claim 7 including providing a second toy comprising a body having an outer shell, the shell having a non-reactive portion and a first reactive portion and an aperture in the shell, a speaker for emitting sound as part of the operation; a blow sensor with the body for sensing a pressure caused by blowing on the shell by an human user in the vicinity of the body; and a microprocessor for processing the blowing pressure, including the steps of blowing at the aperture in the shell of the first or second toy;

sensing a pressure caused by blowing on the shell by an human user in the vicinity of the body of the toy into which there has been a blowing pressure;

activating in the toy into which there has been a blowing pressure; a microprocessor in response to the blowing pressure;

generating in the toy into which there has been a blowing pressure instructions in response to the blowing pressure, causing in the toy into which there has been a blowing pressure an operation of the reactive portion of the body;

emitting a sound in the toy into which there has been a blowing pressure; and causing a responsive reaction from the toy into which there has been a blowing pressure to the other toy.

9. The method as claimed in claim 8 including connecting the toy with a digital input device thereby to link the toy with digital input device through at least one of a USB, Bluetooth™ Zigbee™, or WiFi communication protocol whereby the toy is configured to receive at least one of a predefined object set, voice, melody, song or sound effect from the digital input device.

10. The method as claimed in claim 7 including providing a second toy comprising a body having an outer shell, the shell having a non-reactive portion and a first reactive portion and an aperture in the shell, a speaker for emitting sound as part of the operation; a sound sensor with the body for sensing sound from the first toy, a speaker for emitting sound as part of the operation;

including the steps of blowing at the aperture in the shell of the first toy;

sensing a pressure caused by blowing on the shell by an human user in the vicinity of the body of the first toy;

activating a microprocessor in response to the blowing pressure generating instructions in response to the blowing pressure, causing an operation of the reactive portion of the body, emitting a sound in the toy into which there has been a blowing pressure; and causing a responsive reaction in the second toy.

11. The method as claimed in claim 7 and wherein the change in position of the second reactive portion is a turning of the head of the bird relative to the body of the bird, including two separate controls for:

activating and deactivating the mouth by relative movement of one or both elements of the beak of the bird; and activating in one direction or in an opposite direction or being deactivated respectively and operating the head for turning left, right and returning to a neutral position.

12. The method as claimed in claim 7 including providing several toys to be responsive to at least one of the toys or sounds, the responsiveness being generated from the user or from other of the several toys thereby to obtain a multiple reaction of multiple toys as a started from an initial blowing or sound by a user or by a sound generation by of the multiple toys.

13. An interactive toy comprising:

a first toy bird including a body having an outer shell, the shell having a non-reactive portion and a first reactive portion;

a blow sensor with the body for sensing a pressure caused by blowing on the shell by an human user in the vicinity of the body; and a microprocessor for processing the blowing pressure and generating instructions in response to the blowing pressure, the instructions being for causing operation of the reactive portion of the body;

a speaker for emitting sound as part of the operation;

a second toy bird including a body having an outer shell, the shell having a non-reactive portion and a first reactive portion;

a blow sensor with the body for sensing a pressure caused by blowing on the shell by an human user in the vicinity of the body; and a microprocessor for processing the blowing pressure and generating instructions in response to the blowing pressure, the instructions being for causing operation of the reactive portion of the body;

a speaker for emitting sound as part of the operation;

a reaction by the first toy causing a responsive reaction by the second toy;

wherein the microprocessor includes generating signals independently to sequentially activate and deactivate a first electrical coil thereby to sequentially attract and release a first magnet thereby to cause movement of the interactive toy, the movement being by causing relative changes in position between non-reactive portion and the first reactive portion;

a second reactive portion of the shell, and a second coil, and wherein generating the signals to sequentially activate and deactivate the second electrical coil thereby sequentially attracts and releases a second magnet thereby to cause second movement of the interactive toy, the movement being by causing relative changes in position between a non-reactive portion and a second reactive portion; and the bird having a head, a mouth having a beak with two elements, and a body, and a change in position of the first reactive portion is exhibited as the sequentially opening and closing of the mouth of the bird.

14. An interactive toy comprising:

a first toy bird including a body having an outer shell, the shell having a non-reactive portion and a first reactive portion;

a sensor with the body for sensing a sound caused by an human user in the vicinity of the body; and a microprocessor for processing the sound and generating instructions in response to, the instructions being for causing operation of the reactive portion of the body;

a speaker for emitting sound as part of the operation;

a second toy bird including a body having an outer shell, the shell having a non-reactive portion and a first reactive portion;

a sensor with the body for sensing a sound caused by an human user in the vicinity of the body; and a microprocessor for processing the sound and generating instructions in response to, the instructions being for causing operation of the reactive portion of the body;

a speaker for emitting sound as part of the operation; and a reaction by the first toy causing a responsive reaction by the second toy;

wherein the microprocessor includes generating signals independently to sequentially activate and deactivate a first electrical coil thereby to sequentially attract and release a first magnet thereby to cause movement of the interactive toy, the movement being by causing relative changes in position between non-reactive portion and the first reactive portion;

a second reactive portion of the shell, and a second coil, and wherein generating the signals to sequentially activate and deactivate the second electrical coil thereby sequentially attracts and releases a second magnet thereby to cause second movement of the interactive toy, the movement being by causing relative changes in position between a non-reactive portion and a second reactive portion; and the bird having a head, a mouth having a beak with two elements, and a body, and a change in position of the first reactive portion is exhibited as the sequentially opening and closing of the mouth of the bird.

* * * * *